US005873517A

United States Patent [19]

Lisbon

[11] Patent Number: 5,873,517

[45] Date of Patent: Feb. 23, 1999

[54] STEP-SHAPED TAB FOR LOCKING TOGETHER OVERLAPPING PANELS OF CARDBOARD DEVICES

[76] Inventor: Alfred F. Lisbon, 1645 S. Shenandoah St., Los Angeles, Calif. 90035

[21] Appl. No.: 998,202

[22] Filed: Dec. 24, 1997

[51] Int. Cl.[6] ..... B26D 5/42

[52] U.S. Cl. ..... 229/198.2; 229/103.2; 229/155; 229/933; 206/140

[58] Field of Search ..... 229/198.2, 155, 229/156, 138, 103.2, 154, 933; 206/140, 434, 152

[56] References Cited

U.S. PATENT DOCUMENTS

| | | | |
|---|---|---|---|
| 2,151,202 | 3/1939 | Guyer | 229/155 X |
| 2,326,390 | 8/1943 | Platt | 229/155 X |
| 2,443,431 | 6/1948 | Ringler | 229/155 X |
| 2,843,259 | 7/1958 | Metzger | 206/434 X |
| 3,014,636 | 12/1961 | Fielding | 206/434 |
| 3,223,308 | 12/1965 | Weiss | 206/434 X |
| 3,361,331 | 1/1968 | Weiss | 206/434 |
| 3,989,181 | 11/1976 | Wilcox et al. | 229/155 X |
| 4,775,097 | 10/1988 | Katzman | 229/125.32 X |
| 4,878,612 | 11/1989 | Schuster | 206/434 X |

*Primary Examiner*—Allan N. Shoap
*Assistant Examiner*—Tri M. Mai
*Attorney, Agent, or Firm*—Antonio M. Fernandez

[57] ABSTRACT

Devices cut from cardboard, and preferably corrugated cardboard, are provided with a step-shaped tab at the end of one panel, preferably with only two steps, and a cutout in the end of another overlapped panel with a cutout corresponding to the shape and orientation of the step-shaped tab. A slit even with the second step of the cutout is made with a length of greater extent than the length of the wider first step of the tab such that the slit extends beyond the second step on each side by an extent equal to about twice the width of the first step of the tab, whereby inserting the tab into the slit is facilitated by the second step of the tab in cooperation with the step-shaped cutout, and the tab is locked in the slit by its extended ends pressing on the edges of the first step of the two-step tab.

2 Claims, 8 Drawing Sheets

STEP-SHAPED TAB FOR LOCKING TOGETHER OVERLAPPING PANELS OF CARDBOARD DEVICES

FIELD OF THE INVENTION

The invention relates to devices made from cardboard that have overlapping panels to be locked together by a tab extending from one panel inserted into a slit of the panel such as for a disposable bag-handle grip for plastic grocery bags.

BACKGROUND OF THE INVENTION

There are many devices that are best made of cardboard for their intended purpose, such as a disposable bag-handle grip for plastic grocery bags, a cereal box and a storage case for a tape cassette, such as a Phillips-type audio cassette tape, for example. In such devices there are overlapping panels that are to be locked together conveniently and reliably even after locking and unlocking them repeatedly. When such repetition is expected, the device may be made of heavier weight, solid cardboard, for example, or of more moderate weight, corrugated cardboard consisting of a coarse fluted paper board, i.e., coarse paper board formed to have straight, regular and equally spaced grooves and ridges, with adherent flat paper board on one or both sides to give the fluted paper some rigidity, though still be pliable.

A problem with such devices made of cardboard is providing a way to easily and reliably lock and unlock one panel overlapping another panel and to do so repeatedly without losing the integrity of the locking means, usually provided by a tab extending from the edge of one panel that overlaps the other having a slit into which the tab is inserted, as is commonly done on closing cereal boxes. Thus, once a cereal box has been opened, it may be easily closed with the overlapping panels or flaps locked together by inserting the tab of one flap into the slit of the other. While that provides ease and repeatability with satisfactory reliability for a cereal box, which normally serves out its normal life span on a shelf without any undue stress in relocking the flaps, it might not be satisfactory for boxes destined to serve for more active purposes over an indefinite period, such as a box for a Phillips-type audio cassette, or for more stressful purposes, such as a grip for holding together handles of one or more ubiquitous plastic grocery bags.

STATEMENT OF THE INVENTION

In accordance with the present invention, a robust and reliable means is provided for locking together overlapping panels of a device, comprising a plurality of contiguous panels cut out of the same cardboard sheet with one panel having a step-shaped tab extending from an end thereof, that step-shaped tab having a first step of a selected width and length, and a second step over the first of lesser width than the first step and of some convenient length centered on the first step. At the end of another panel to be overlapped by the panel with the extending tab, there is an identical step-shape cut out.

The first step cut in the other panel matches the first, wider step of the tab, and the second narrower step cut further into the cardboard sheet matches the second step of the tab on top of the first. At the same time that the second step of the cutout is made, a slit is cut in the cardboard sheet parallel to the first, wider step that is cut out. That cut is made to be of greater length at each end than the width of the first step of the cutout by an extent equal to about twice the thickness of the cardboard sheet. The cardboard is scored at various places where it is to fold or bend sharply along a straight line to form the device and in so doing overlap the other panel having a slit with which the tab is aligned.

The tab is also scored at the base of each of its two steps so that as the panel with the tab is folded to overlap the panel with the cutout, the tab will bend at the base of the first and the base of the second step, permitting the second step of the tab to enter the matching cutout second step until the top of the first step of the tab reaches the base of the second narrower step in the cutout.

That then forces the first wider step of the tab to ride over the sides of the narrower step in the cutout and thus follow the narrower second step of the tab into the slit of the panel with a cutout. Thus, the second step of the tab serves as a guide in entering the first wider step of the cutout and then to pass over the second narrower step of the cutout until the first wider step of the tab reaches the slit and follows the second narrower step of the tab into the slit forcing the tab to fully penetrate the slit. The tight fit of the slit around the tab locks the tab in place.

The positions of the scored lines of the sheet are so located as to define a linear array of four panels such that when the panels are folded, all in the same direction, the device thus formed and locked by the tab will be in a quadrilateral shape for use as a grip for plastic grocery bag handles, or rectangular for that or other purposes, such as a sleeve for credit cards, calling cards, or a Phillips-type audio tape. For any of these other applications of the rectangular shapes, flaps may be provided on both sides of one panel at the same time that the device with a tab, cutout and scored lines is die cut. When folded in under the overlapping panels having the tab and slit, the flaps serve as end walls of a box.

For application of this invention to other boxes, such as cereal boxes, the panel with a tab overlapping another panel with a slit, are simply cut with the two-step tab and cutout while the other panels of the box are cut in the same manner and for the same purpose as for all other applications of this invention.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
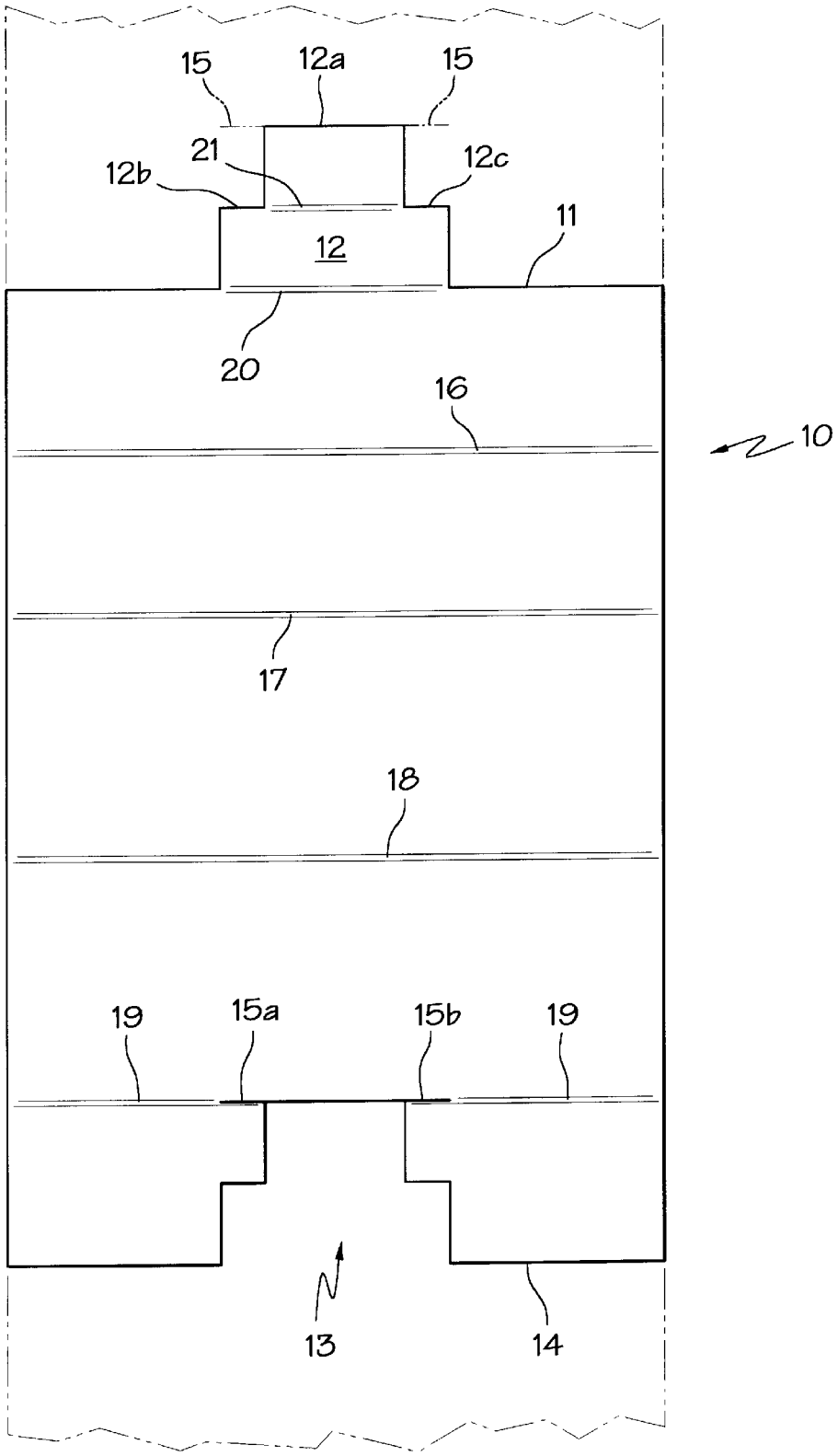
FIG. 1 is a plan view of a bag handle grip die cut from a sheet of corrugated cardboard in accordance with the present invention.

Referring to FIG. 1, a bag-handle grip 10 made in accordance with this invention is die cut in the shape shown from a sheet of cardboard, preferably corrugated cardboard having a thickness of about 1.5 mm. At one end 11 there is a two-step tab 12 with the second step 12*a* having a width less than the first step to provide a wider first step 12*b* and 12*c* below the second step 12*a*. This tab cut out of a sheet of cardboard leaves a cutout in an adjacent bag-handle grip pattern that is die cut at the same time as shown in the upper part of the figure.

Figure 2:
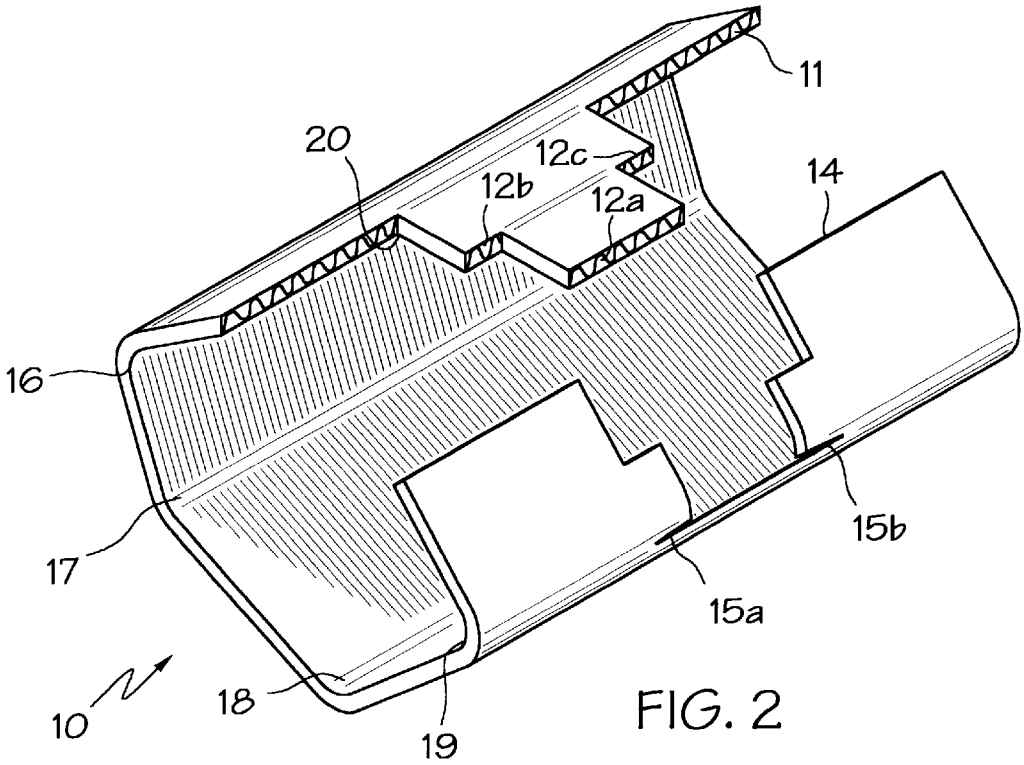
FIG. 2 illustrates the bag handle grip of FIG. 1 bent at four predetermined places scored for that purpose so that one end having a tab will overlap an opposite end having a cutout and a slit for receiving the tab which is scored in two places to facilitate inserting the tab in the slit.

At the same time, a tab of the same shape (shown in phantom lines in the figure) is cut out for an adjacent bag-handle grip pattern, leaving a two-step cutout 13 on the other end 14 of the bag-handle grip 10. It should be noted that the knife for cutting the second step 12*a* effectively cuts a slit 15 in the pattern shown in phantom lines on the adjacent bag-handle grip above the bag-handle grip 10. Thus, while die cutting a baghandle grip pattern in the sheet of cardboard on the other end 14 of the bag-handle grip 10, the knife for the slit 15 above (shown in phantom) leaves slits 15*a* and 15*b* in the corrugated cardboard bag-handle grip 10. Although that slit for the tab 12, sometimes said to be in the singular, is in fact two slits. However, it functions effectively as one to receive the steps 12*b* and 12*c* of the two-step tab, as will now be described with reference to FIG. 2.

In folding the die-cut pattern of corrugated cardboard to form a bag-handle grip, the upper end 11 is folded down at the scored lines 16 and 17 while the lower end 14 is folded up at lines 18 and 19. The first and second steps of the tab 12 are then folded in toward the center of the grip at scored lines 20 and 21 in FIG. 1 so that the second step 12*a* easily passes through the identically shaped cutout in the lower end 14. As the first step 12*a* moves further into the bag-handle grip, that step 12*a* passing through between the slits 15*a* and 15*b*. Further motion of the step 12*a* through the slits forces the second steps 12*b* and 12*c* into the slits 15*a* and 15*b* until both second steps 12*b* and 12*c* fully penetrate the slits 15*a* and 15*b* which grip the tab to hold it in a more secure locked position. In that manner, the bag-handle grip 10 may be easily closed in a trapezoidal shape around one or more plastic grocery bags.

An advantage of this diecut bag-handle grip pattern is that a large number of such patterns may be simultaneously diecut from a large sheet. For that purpose, the die is made with cutting knives or edges and ridges for scoring lines in any one of a number of bag-handle grip patterns arrayed in rows and columns. High volume production is thus possible without any loss of cardboard material as scraps.

Figure 3:
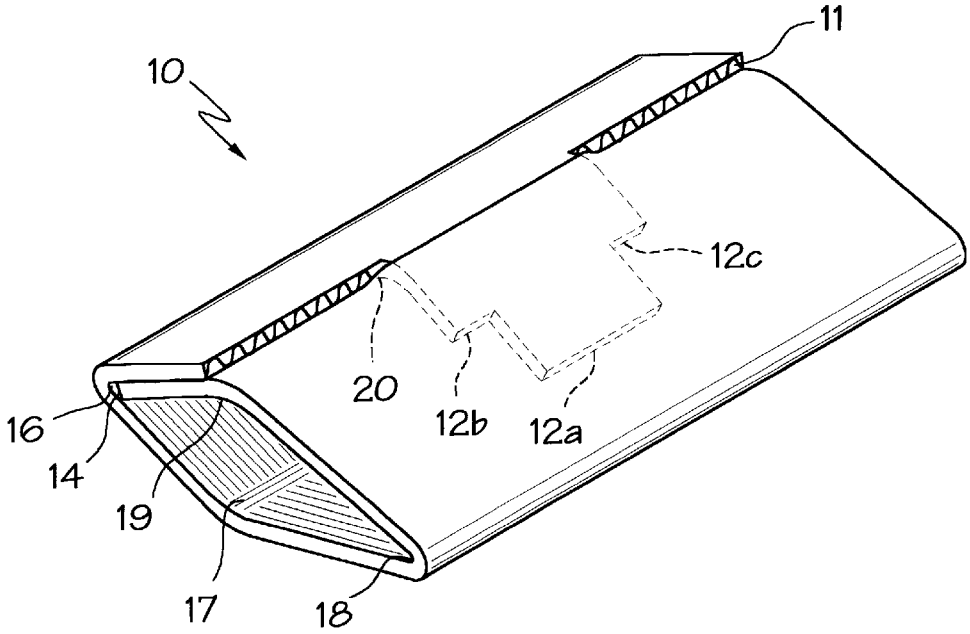
FIG. 3 illustrates the bag handle grip of FIGS. 1 and 2 with the locking tab inserted through the slit in place.
Figure 4:
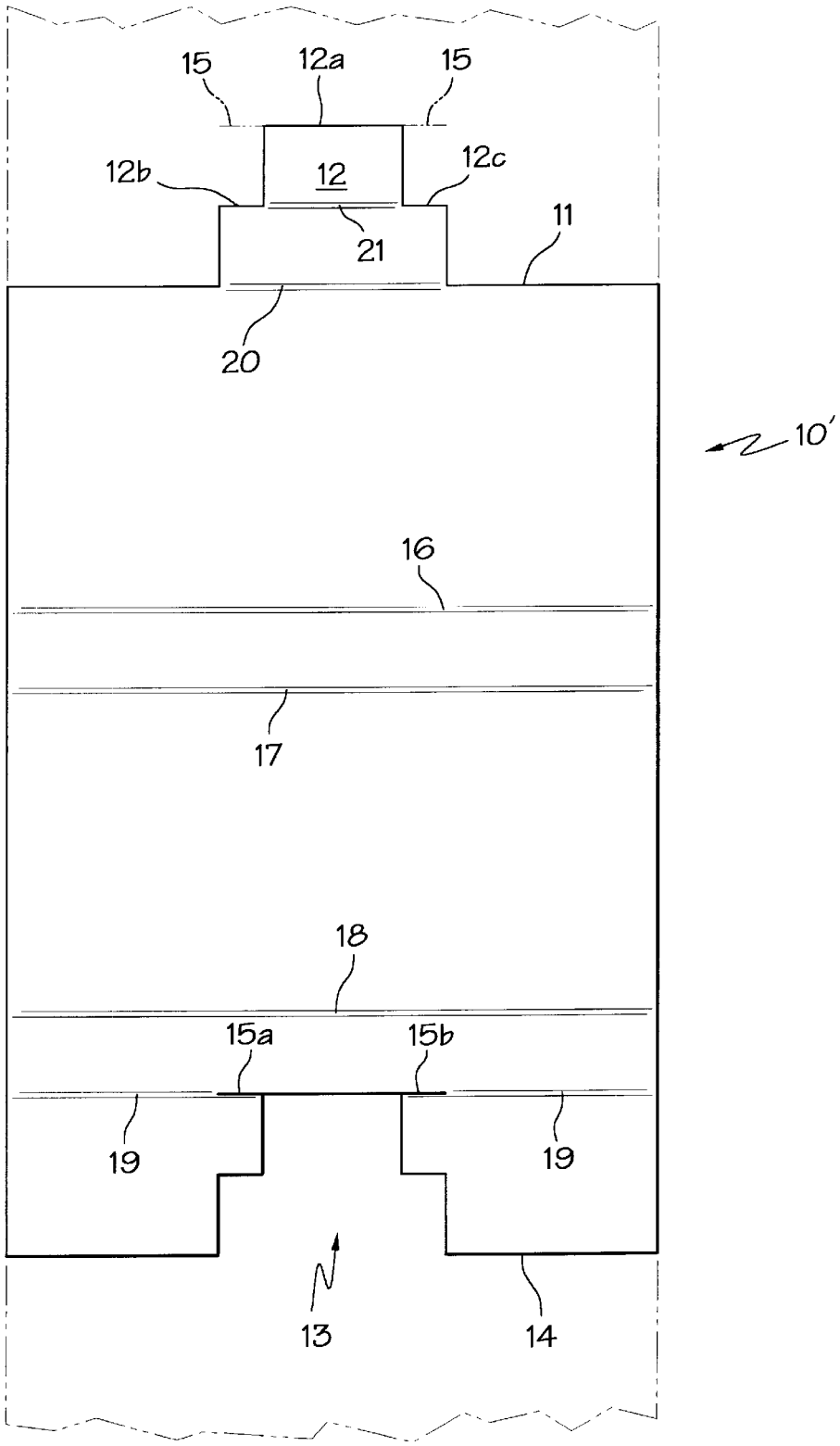
FIG. 4 is a plan view of a device die cut from a sheet of corrugated cardboard with a pattern of scored lines in another arrangement for locking the device securely closed with a tab inserted through a slit at a folded corner.
Figure 5:
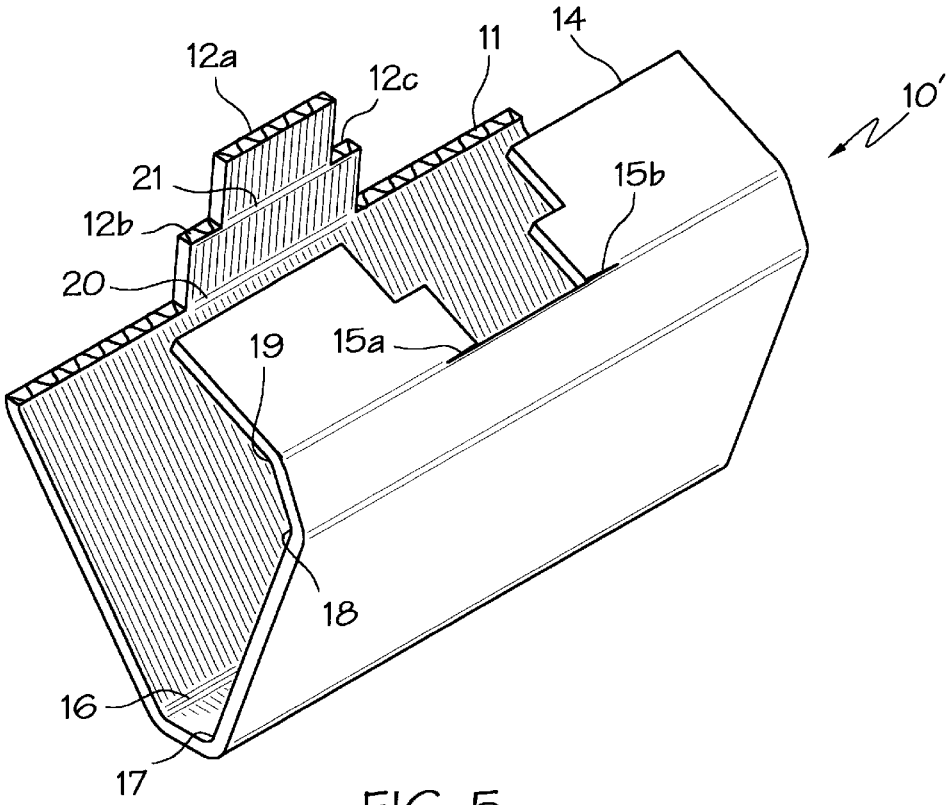
FIG. 5 illustrates the device of FIG. 1 partially closed.
Figure 6:
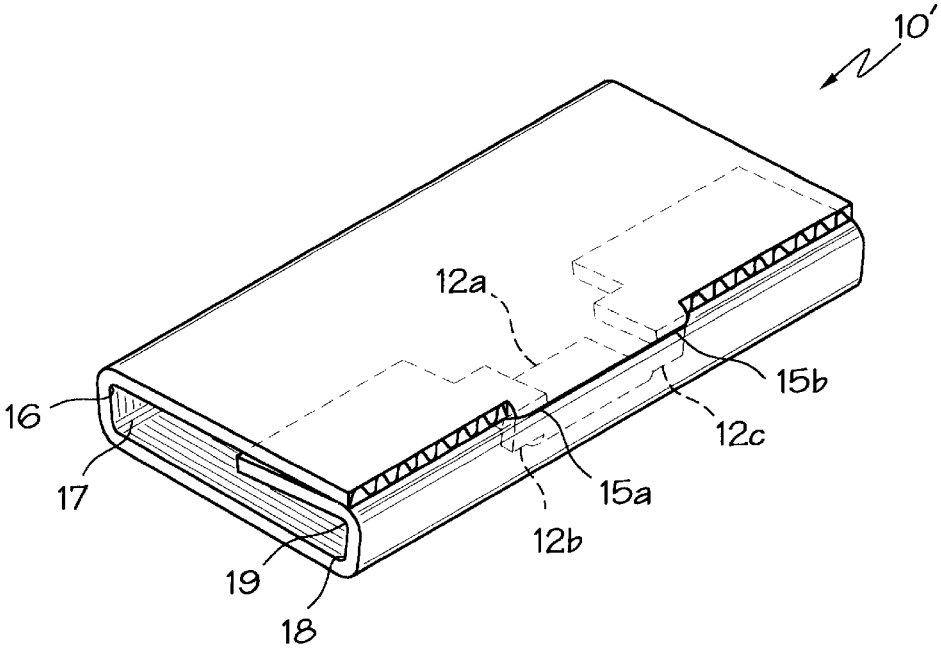
FIG. 6 illustrates the device of FIGS. 4 and 5 fully closed and locked by a tab inserted through a slit at a corner.

Referring next to FIG. 4, a pattern is shown for diecut cardboard similar to that shown for a bag-handle grip 10, and is thus so identified by the same reference numerals for all elements. What is different is the location of each of scored lines 16, 17, and 18. That difference results in a device of a different shape as illustrated by FIGS. 5 and 6, with the locking tab 12 entering the slits 15*a* and 15*b* as before, but the tab bending through 90° at the scored line 21, with the resulting corner of that top nested in the adjacent corner defined by the scored line 18. The scored lines 16 and 17 are positioned to produce 90° corners spaced apart equal to the space between 90° corners of the device. The result is a device that may be used as a bag-handle grip or alternatively as a tab-locked sleeve for a Phillips-type tape cassette, provided the inside dimensions are selected to accommodate a standard size Phillips-type tape cassette, or for that matter any other tape cassette of larger of smaller dimensions. The organization and operation of the device remains the same for each application as for the bag handle grip of FIGS. 1, 2 and 3.

Figure 7:
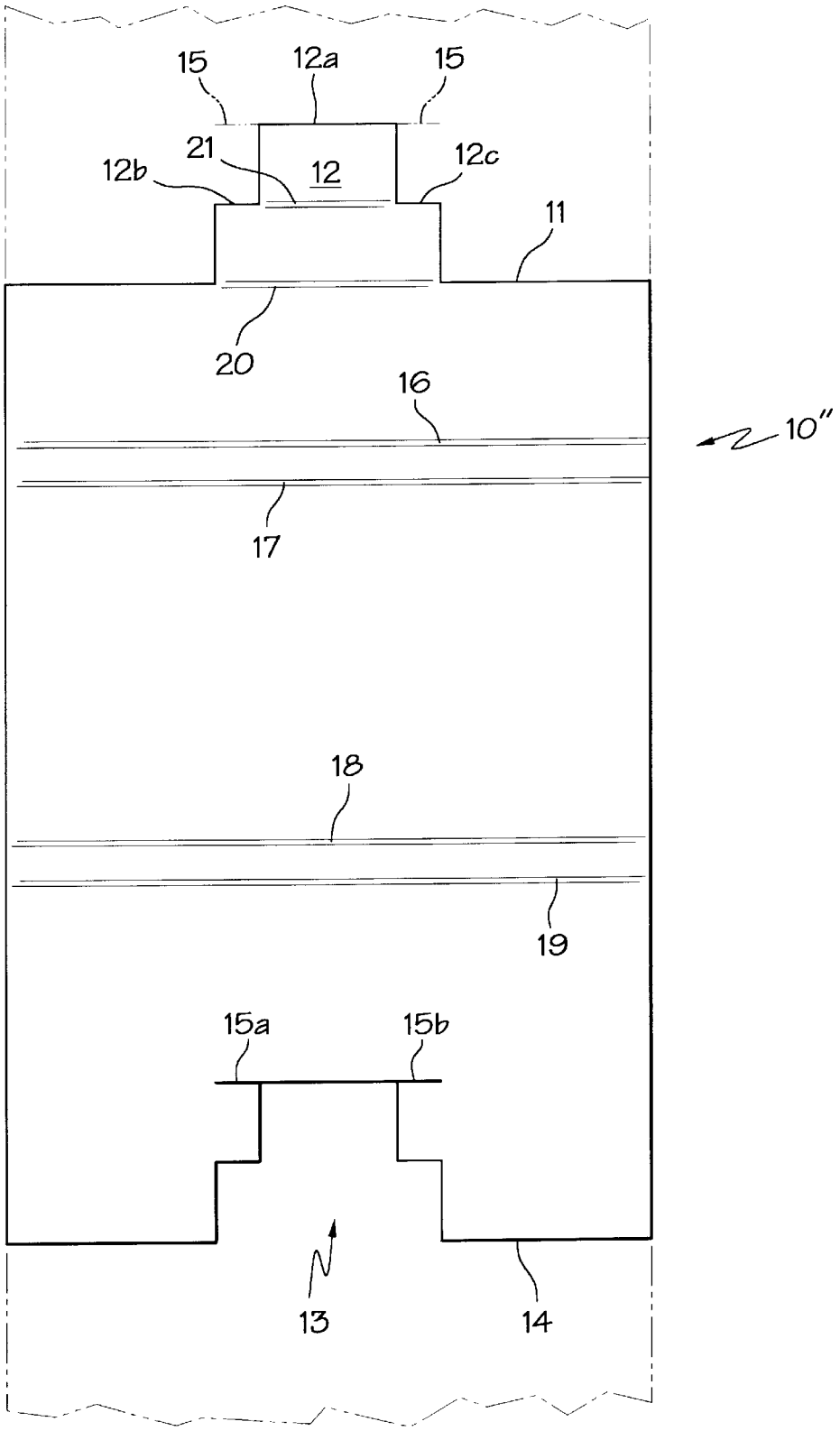
FIG. 7 is a plan view of a device cut from a sheet of corrugated cardboard with yet another arrangement for locking the device securely closed with a tab inserted through a slit midway between folded corners.
Figure 8:
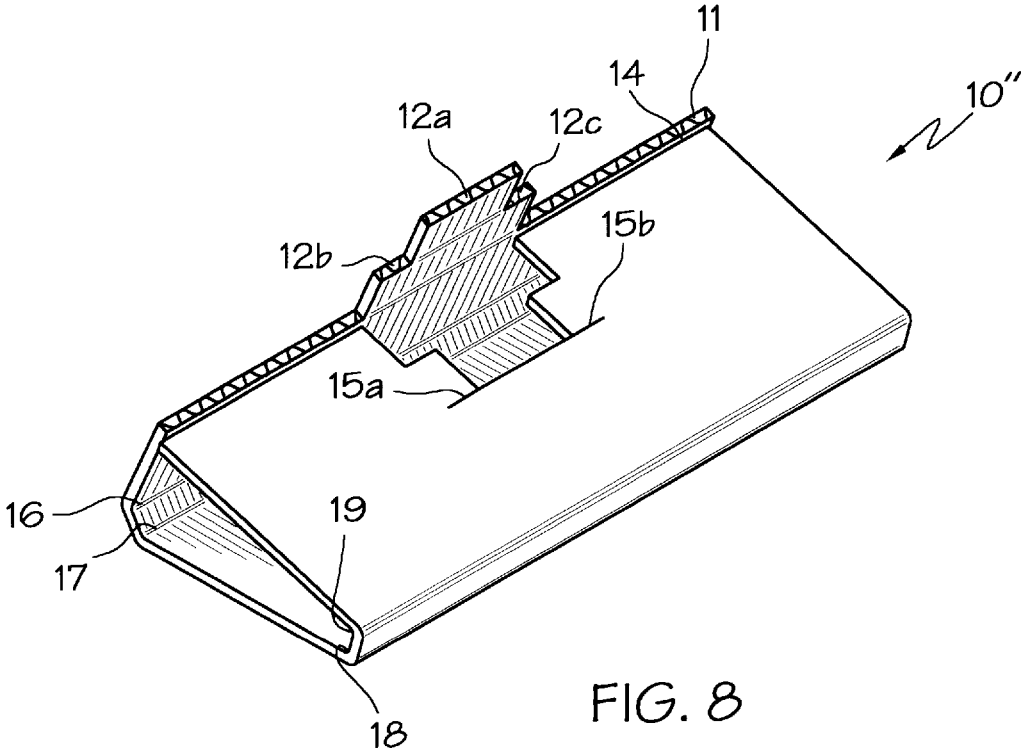
FIG. 8 illustrates the device of FIG. 7 partially closed.
Figure 9:
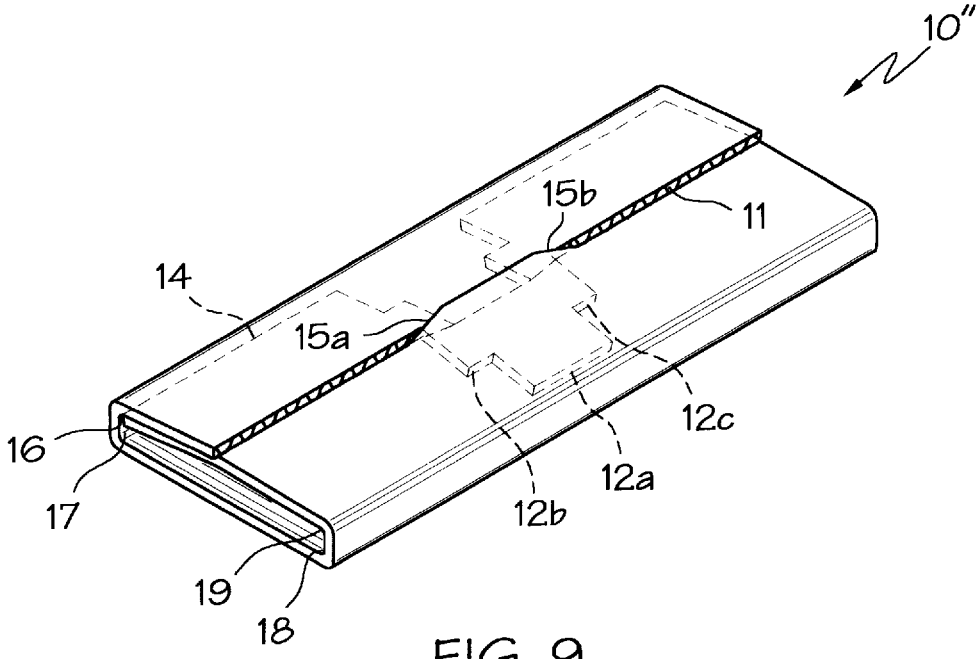
FIG. 9 illustrates the device of FIGS. 7 and 8 fully closed and locked by a tab inserted through a slit midway between corners.

Yet another alternative pattern illustrated in FIG. 7 in which the positions of scored lines 16, 17, 18, and 19 have been arranged to produce a device shown in FIGS. 8 and 9 similar to the device shown in FIGS. 5 and 6. The difference is that the locking tab enters the slits 15*a* and 15*b* not in the corner as in FIG. 6, but in the middle of the upper side of the device. Again this device may be used in similar ways as the device of FIGS. 5 and 6, depending only on the dimensions selected.

Figure 10:
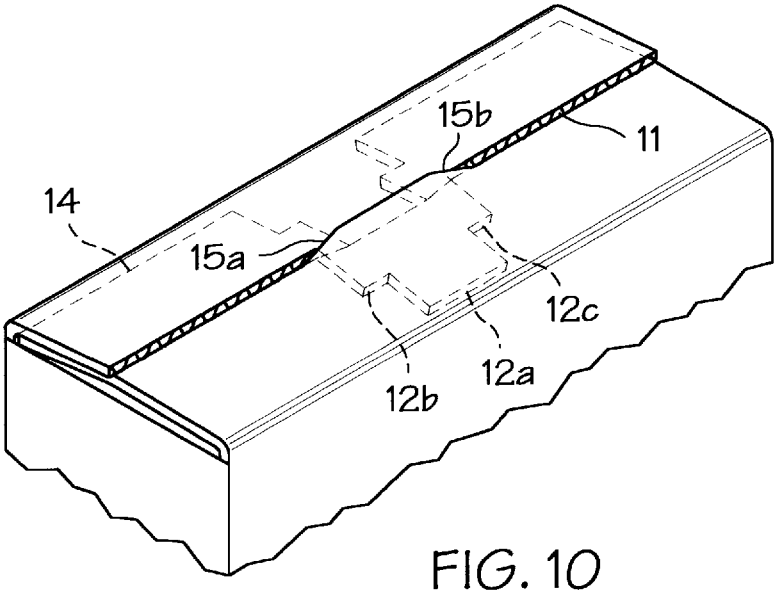
FIG. 10 illustrates a panel with a tab inserted in a slit for locking closed flaps of a box in the same way as shown in FIGS. 8 and 9 for a device.

The tab-locking scheme of the device illustrated in FIG. 9 may also be used for locking overlapping flaps of a box, such as a cereal box shown in FIG. 10. The ends 11 and 14 of the panels shown here correspond to the ends 11 and 14 of the panels shown in FIG. 9, and so the same reference numerals for the tab-locking scheme are applied in FIG. 10 for the cereal box or other similar box. The box would, of course, include side flaps that fold in before the overlapping ends 11 and 14 of panels are folded and locked by the tab.

Figure 11:
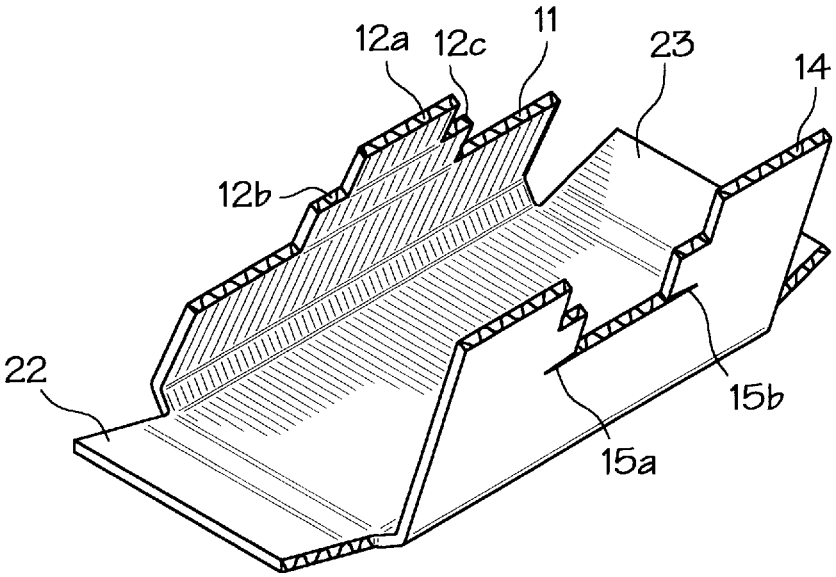
FIG. 11 illustrates partially closed a device cut from a sheet of corrugated cardboard in a pattern the same as that shown in FIG. 7 but with two side flaps for an alternate form of the same device.

To illustrate this accommodation of side flaps for a box, reference is now made to FIG. 11 which may be a box for a Phillips-type tape cassette depending only on the dimensions which must be selected to provide inside dimensions of the box slightly greater than the outside dimensions of the cassette. In this application, each of two side flaps 22 and 23 are scored along two lines so that there is first defined a 90° corner at the bottom and then a 90° corner at the top when the flaps are folded over the cassette. After that, the overlapping ends 11 and 14 of panels are folded over the flaps 22 and 23 and the second step 12*a* of the locking tab is used to guide the first steps 12*b* and 12*c* into the slits 15*a* and 15*b*. The locking tab on the top of the box thus locks in the middle in the same manner as in the cereal box of FIG. 10.

Figure 12:
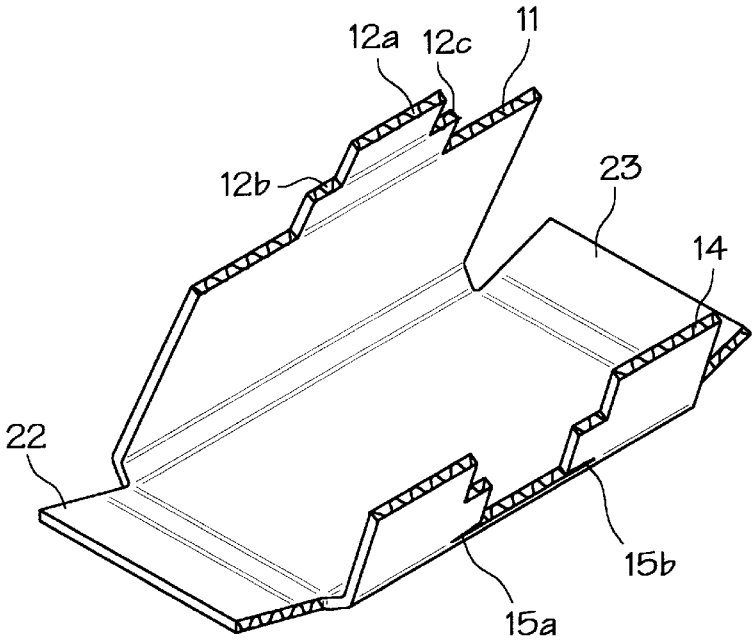
FIG. 12 illustrates partially closed a device cut from a sheet of corrugated cardboard in a pattern the same as that shown in FIG. 4 but with two side flaps similar to flaps shown in FIG. 11. The box will lock on the corner in the manner described with reference to FIGS. 5 and 6.

An alternative arrangement of the locking tab scheme shown in FIG. 11 for a box is shown in FIG. 12. That alternative allows for locking the box with the tab at a corner in the same manner as for the device shown in FIG. 6.

Figure 13:
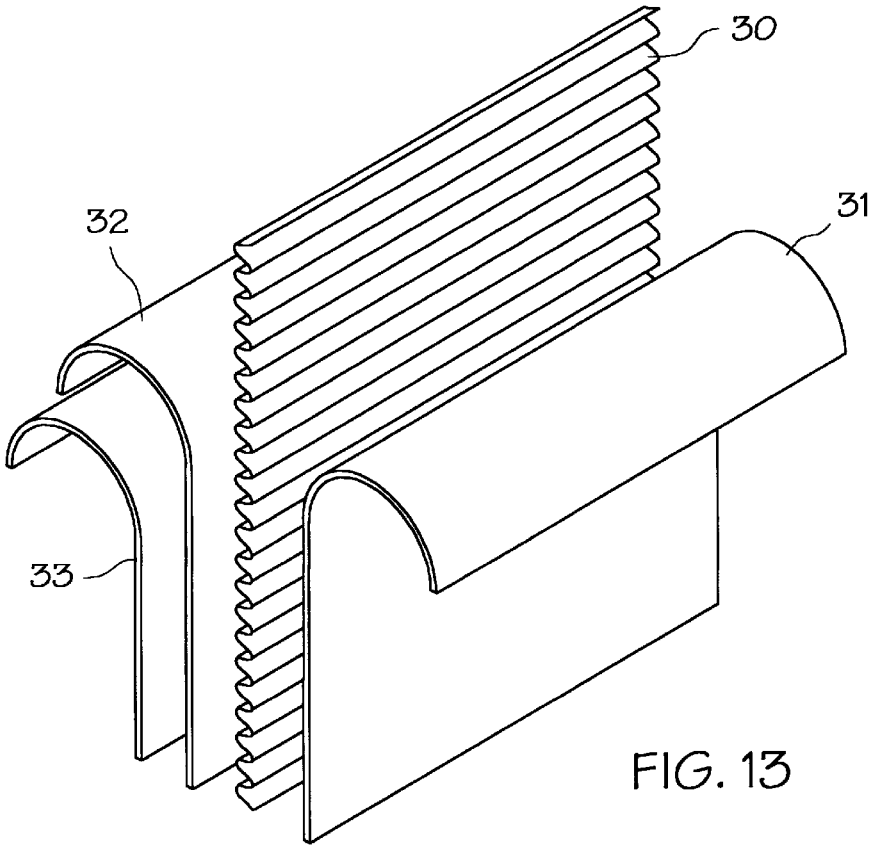
FIG. 13 illustrates the nature of the preferred corrugated cardboard that includes a core of coarse paper corrugated and two sheets of paper, one sheet laminated on each side of the core, and a plastic sheet laminated onto the sheet on one side.

All of the devices shown are made from patterns cut out of cardboard and preferably corrugated cardboard as shown in FIG. 13 having a core 30 of corrugated coarse paper with sheets of paper 31 and 32 laminated on both sides. One of the two sheets 31 and 32 may be designated to be on the outside of the devices, and then be preprinted on the outside with indicia which is in turn protected by a film 33 of plastic laminated over it. Alternatively, the sheet of corrugated cardboard may be fabricated and at the time of die cutting patterns for the devices laminated with the film 33 which has been preprinted with indicia on the inside or the outside.

Although particular embodiments of the invention have been described and illustrated herein, it is recognized that modifications may readily occur to those skilled in the art. Consequently, it is intended that the claims be interpreted to cover such modifications and equivalents thereof.

What is claimed is:

1. Apparatus cut out of a sheet of cardboard for locking together overlapping ends of first and second panels of a device, comprising a step-shaped tab of at least two steps at the end of said first panel, a first step having a first width, and a second step over said first step of lesser width centered on said first step and a cutout of identical step-shape in the end of said second panel, said cutout being oriented in the same direction as said tab, a slit cut even with the top of said second step of said cutout, the extent of said slit being greater than said width of said first step of said tab by an amount about equal to twice the thickness of said cardboard, wherein said first step cut in said end of said second panel matches said first step of said tab in width, and said second step cut in said end of said second panel matches in width said second step of said tab, whereby, when said tab is inserted into said cutout, said second step guides said first step into said slit, thereby allowing said first step of said tab to enter into said slit of said cutout while allowing said slit of greater width than said width of said first step of said tab to grip edges of said first step of said tab and to hold said tab in a locking position.

2. Apparatus as defined in claim 1 including a plurality of scored lines parallel to said ends, each scored line defining where the cardboard of said device is to fold in forming said device such that said one end overlaps the other to form a tab-locked closure for said device.

* * * * *